US010798517B2

(12) United States Patent
Murata et al.

(10) Patent No.: US 10,798,517 B2
(45) Date of Patent: Oct. 6, 2020

(54) OUT-OF-HEAD LOCALIZATION FILTER DETERMINATION SYSTEM, OUT-OF-HEAD LOCALIZATION FILTER DETERMINATION DEVICE, OUT-OF-HEAD LOCALIZATION FILTER DETERMINATION METHOD, AND PROGRAM

(71) Applicant: JVCKENWOOD Corporation, Yokohama-shi, Kanagawa (JP)

(72) Inventors: Hisako Murata, Yokohama (JP); Masaya Konishi, Yokohama (JP); Takahiro Gejo, Yokohama (JP); Kuniaki Takachi, Yokohama (JP); Yumi Fujii, Yokohama (JP); Takayuki Uchida, Yokohama (JP)

(73) Assignee: JVCKENWOOD Corporation, Yokohama-shi, Kanagawa (JP)

( * ) Notice: Subject to any disclaimer, the term of this patent is extended or adjusted under 35 U.S.C. 154(b) by 0 days.

(21) Appl. No.: 16/675,052

(22) Filed: Nov. 5, 2019

(65) Prior Publication Data

US 2020/0068337 A1 Feb. 27, 2020

Related U.S. Application Data

(63) Continuation of application No. PCT/JP2018/017050, filed on Apr. 26, 2018.

(30) Foreign Application Priority Data

May 10, 2017 (JP) ..... 2017-093733

(51) Int. Cl.
*H04S 7/00* (2006.01)
*H04R 5/027* (2006.01)
(Continued)

(52) U.S. Cl.
CPC ..... *H04S 7/307* (2013.01); *H04R 5/027* (2013.01); *H04R 5/033* (2013.01); *H04R 5/04* (2013.01)

(58) Field of Classification Search
CPC ..... H04S 7/307; H04R 5/027; H04R 5/033; H04R 5/04
See application file for complete search history.

(56) References Cited

U.S. PATENT DOCUMENTS 6,801,627 B1 10/2004 Kobayashi
2011/0249851 A1 10/2011 Iwano et al.
(Continued)

FOREIGN PATENT DOCUMENTS

JP H08-111899 A 4/1996
JP 2000-115899 A 4/2000
(Continued)

*Primary Examiner* — Andrew L Sniezek
(74) *Attorney, Agent, or Firm* — Procopio, Cory, Hargreaves & Savitch LLP

(57) ABSTRACT

An out-of-head localization filter determination system according to an embodiment includes headphones, a microphone unit, an out-of-head localization device, and a server device. The out-of-head localization device transmits user data based on measurement data to the server. The server device includes a data storage unit configured to store a plurality of first and second preset data acquired for a plurality of persons being measured, a comparison unit configured to compare the user data with the plurality of second preset data, and an extraction unit configured to extract first preset data from the plurality of first preset data based on a comparison result.

6 Claims, 12 Drawing Sheets

(51) Int. Cl.
*H04R 5/033* (2006.01)
*H04R 5/04* (2006.01)

(56) References Cited

U.S. PATENT DOCUMENTS

| | | | | |
|---|---|---|---|---|
| 2013/0169779 | A1* | 7/2013 | Pedersen | G06K 9/00362 348/77 |
| 2018/0048959 | A1* | 2/2018 | Fujii | H04S 1/00 |
| 2018/0176709 | A1 | 6/2018 | Konishi et al. | |
| 2018/0367937 | A1* | 12/2018 | Asada | G10L 15/22 |

FOREIGN PATENT DOCUMENTS

| | | | |
|---|---|---|---|
| JP | 2000-324590 | A | 11/2000 |
| JP | 2010-011444 | A | 1/2010 |
| JP | 2015-211235 | A | 11/2015 |
| JP | 2017-028525 | A | 2/2017 |
| JP | 2017-041766 | A | 2/2017 |

* cited by examiner

| ID OF PERSON BEING MEASURED | LEFT/RIGHT | FEATURE QUANTITY | SPATIAL ACOUSTIC TRANSFER CHARACTERISTICS 1 | SPATIAL ACOUSTIC TRANSFER CHARACTERISTICS 2 |
|---|---|---|---|---|
| ID_A | L | hpL_A | Hls_A | Hro_A |
| ID_A | R | hpR_A | Hrs_A | Hlo_A |
| ID_B | L | hpL_B | Hls_B | Hro_B |
| ID_B | R | hpR_B | Hrs_B | Hlo_B |
| ⋮ | ⋮ | ⋮ | ⋮ | ⋮ |

Fig. 6

| ID OF PERSON BEING MEASURED | LEFT/RIGHT | EAR CANAL TRANSFER CHARACTERISTICS | SPATIAL ACOUSTIC TRANSFER CHARACTERISTICS 1 | SPATIAL ACOUSTIC TRANSFER CHARACTERISTICS 2 |
|---|---|---|---|---|
| ID_A | L | ECTFL_A | Hls_A | Hlo_A |
| ID_A | R | ECTFR_A | Hrs_A | Hro_A |
| ID_B | L | ECTFL_B | Hls_B | Hlo_B |
| ID_B | R | ECTFR_B | Hrs_B | Hro_B |
| ⋮ | ⋮ | ⋮ | ⋮ | ⋮ |

Fig. 10

| ID OF PERSON BEING MEASURED | LEFT/ RIGHT | FEATURE QUANTITY | EAR CANAL TRANSFER CHARACTERISTICS | DELAY (delay) | level | SPATIAL ACOUSTIC TRANSFER CHARACTERISTICS 1 | SPATIAL ACOUSTIC TRANSFER CHARACTERISTICS 2 |
|---|---|---|---|---|---|---|---|
| ID_A | L | hpL_A | ECTFL_A | ITDL_A | ILDL_A | Hls_A | Hlo_A |
| ID_A | R | hpR_A | ECTFR_A | ITDR_A | ILDR_A | Hrs_A | Hro_A |
| ⋮ | ⋮ | ⋮ | ⋮ | ⋮ | ⋮ | ⋮ | ⋮ |

Fig. 11

| ID OF PERSON BEING MEASURED | LEFT/ RIGHT | FEATURE QUANTITY 1 | FEATURE QUANTITY 2 | FREQUENCY-PHASE CHARACTERISTICS 1 | FREQUENCY-PHASE CHARACTERISTICS 2 | FREQUENCY-AMPLITUDE CHARACTERISTICS 1 | FREQUENCY-AMPLITUDE CHARACTERISTICS 2 |
|---|---|---|---|---|---|---|---|
| ID_A | L | hpL_A | hpL_low_A | Hls_p_A | Hro_p_A | Hls_am_A | Hro_am_A |
| ID_A | R | hpR_A | hpR_low_A | Hrs_p_A | Hlo_p_A | Hrs_am_A | Hlo_am_A |
| ⋮ | ⋮ | ⋮ | ⋮ | ⋮ | ⋮ | ⋮ | ⋮ |

Fig. 12

OUT-OF-HEAD LOCALIZATION FILTER DETERMINATION SYSTEM, OUT-OF-HEAD LOCALIZATION FILTER DETERMINATION DEVICE, OUT-OF-HEAD LOCALIZATION FILTER DETERMINATION METHOD, AND PROGRAM

CROSS REFERENCE TO RELATED APPLICATION

This application is based upon and claims the benefit of priority from Japanese patent application No. 2017-93733 filed on May 10, 2017, and is a Continuation of International application No. PCT/JP2018/017050 filed on Apr. 26, 2018, the disclosure of which are incorporated herein in its entirety by reference.

BACKGROUND

The present invention relates to an out-of-head localization filter determination system, an out-of-head localization filter determination device, an out-of-head localization filter determination method, and a program.

Sound localization techniques include an out-of-head localization technique, which localizes sound images outside the head of a listener by using headphones. The out-of-head localization technique localizes sound images outside the head by canceling characteristics from the headphones to the ears and giving four characteristics from stereo speakers to the ears.

In out-of-head localization reproduction, measurement signals (impulse sounds etc.) that are output from 2-channel (which is referred to hereinafter as "ch") speakers are recorded by microphones (which can be also called "mike") placed on the listener's ears. Then, a processing device generates a filter based on a sound pickup signal obtained by impulse response. The generated filter is convolved to 2-ch audio signals, thereby implementing out-of-head localization reproduction.

Patent Literature 1 (Japanese Unexamined Patent Application Publication No. H8-111899) discloses a binaural listening device using an out-of-head localization filter. This device transforms spatial transfer functions of a large number of persons measured in advance into feature parameter vectors corresponding to human auditory characteristics. The device then performs clustering and uses data aggregated into small clusters. The device further performs clustering of the spatial transfer functions measured in advance and real-ear inverse headphone transfer functions by human physical dimensions. It then uses data of a person that is nearest to the center of mass of each cluster.

Patent Literature 2 (Japanese Unexamined Patent Application Publication No. 2015-211235) discloses a stereophonic sound reproduction device using headphones. The device of Patent Literature 2 measures the depth of a first part of one ear of a user. Based on this depth, the device retrieves a head-related transfer function that is personally adapted to the user from a head-related transfer function database.

Patent Literature 3 (Japanese Unexamined Patent Application Publication No. 2017-41766) and Patent Literature 4 (Japanese Unexamined Patent Application Publication No. 2017-28525) disclose a method for a user to select an optimum filter from a plurality of filters based on auditory test results.

SUMMARY

However, because the device of Patent Literature 1 performs clustering by physical dimensions, it needs to measure the physical dimensions of an individual user. Further, there is a possibility that appropriate clustering cannot be performed. This leads to a problem that it is not possible to use an out-of-head localization filter suitable for a user.

Patent Literature 2 needs to measure the depth of the first part of the ear. It is thus difficult for a user to measure the depth of his or her own ear. Further, in the methods of Patent Literatures 1 and 2, there is a possibility that measurement data varies depending on a person measuring it.

In the methods of Patent Literatures 3 and 4, a user needs to listen to all of several patterns of presented preset characteristics. This leads to a problem that an increase in the number of patterns results in a longer trial listening time.

An out-of-head localization filter determination system according to an embodiment is an out-of-head localization filter determination system including an output unit configured to be worn on a user and output sounds to an ear of the user, a microphone unit configured to be worn on the ear of the user and pick up sounds output from the output unit, a user terminal configured to output a measurement signal to the output unit and acquire a sound pickup signal output from the microphone unit, and a server device configured to be able to communicate with the user terminal, wherein the user terminal includes a measurement unit configured to measure measurement data related to ear canal transfer characteristics of the ear of the user by using the output unit and the microphone unit, and a transmitting unit configured to transmit user data based on the measurement data to the server device, and the server device includes a data storage unit configured to store first preset data related to spatial acoustic transfer characteristics from a sound source to an ear of a person being measured and second preset data related to ear canal transfer characteristics of the ear of the person being measured in association with each other, and store a plurality of first and second preset data acquired for a plurality of persons being measured, a comparison unit configured to compare the user data with the plurality of second preset data, and an extraction unit configured to extract first preset data from the plurality of first preset data based on a comparison result in the comparison unit.

An out-of-head localization filter determination device according to an embodiment includes an acquisition unit configured to acquire user data based on measurement data related to ear canal transfer characteristics of an ear of a user, a data storage unit configured to store first preset data related to spatial acoustic transfer characteristics from a sound source to an ear of a person being measured and second preset data related to ear canal transfer characteristics of the ear of the person being measured in association with each other and store a plurality of first and second preset data acquired for a plurality of persons being measured, and an extraction unit configured to compare the user data with the plurality of second preset data and thereby extract first preset data from the plurality of first preset data.

An out-of-head localization filter determination method according to an embodiment includes a step of acquiring user data based on measurement data related to ear canal transfer characteristics of an ear of a user, a step of storing a plurality of first and second preset data acquired for a plurality of persons being measured, in such a way that associates first preset data related to spatial acoustic transfer characteristics from a sound source to an ear of a person being measured and second preset data related to ear canal transfer characteristics of the ear of the person being measured, and a step of comparing the user data with the plurality of second preset data and thereby extracting first preset data from the plurality of first preset data.

A program according to an embodiment causes a computer to execute a step of acquiring user data based on measurement data related to ear canal transfer characteristics of an ear of a user, a step of storing a plurality of first and second preset data acquired for a plurality of persons being measured, in such a way that associates first preset data related to spatial acoustic transfer characteristics from a sound source to an ear of a person being measured and second preset data related to ear canal transfer characteristics of the ear of the person being measured, and a step of comparing the user data with the plurality of second preset data and thereby extracting first preset data from the plurality of first preset data.

According to the embodiment, it is possible to provide an out-of-head localization filter determination system, an out-of-head localization filter determination device, an out-of-head localization filter determination method, and a program capable of appropriately determining an out-of-head localization filter.

BRIEF DESCRIPTION OF THE DRAWINGS

FIG. 6 is a table showing the data structure of preset data stored in the server device.

FIG. 10 is a table showing a data structure in a modified example 1.

FIG. 11 is a table showing a data structure in a modified example 2.

FIG. 12 is a table showing a data structure in a modified example 3.

DETAILED DESCRIPTION (Overview)

Figure 1:
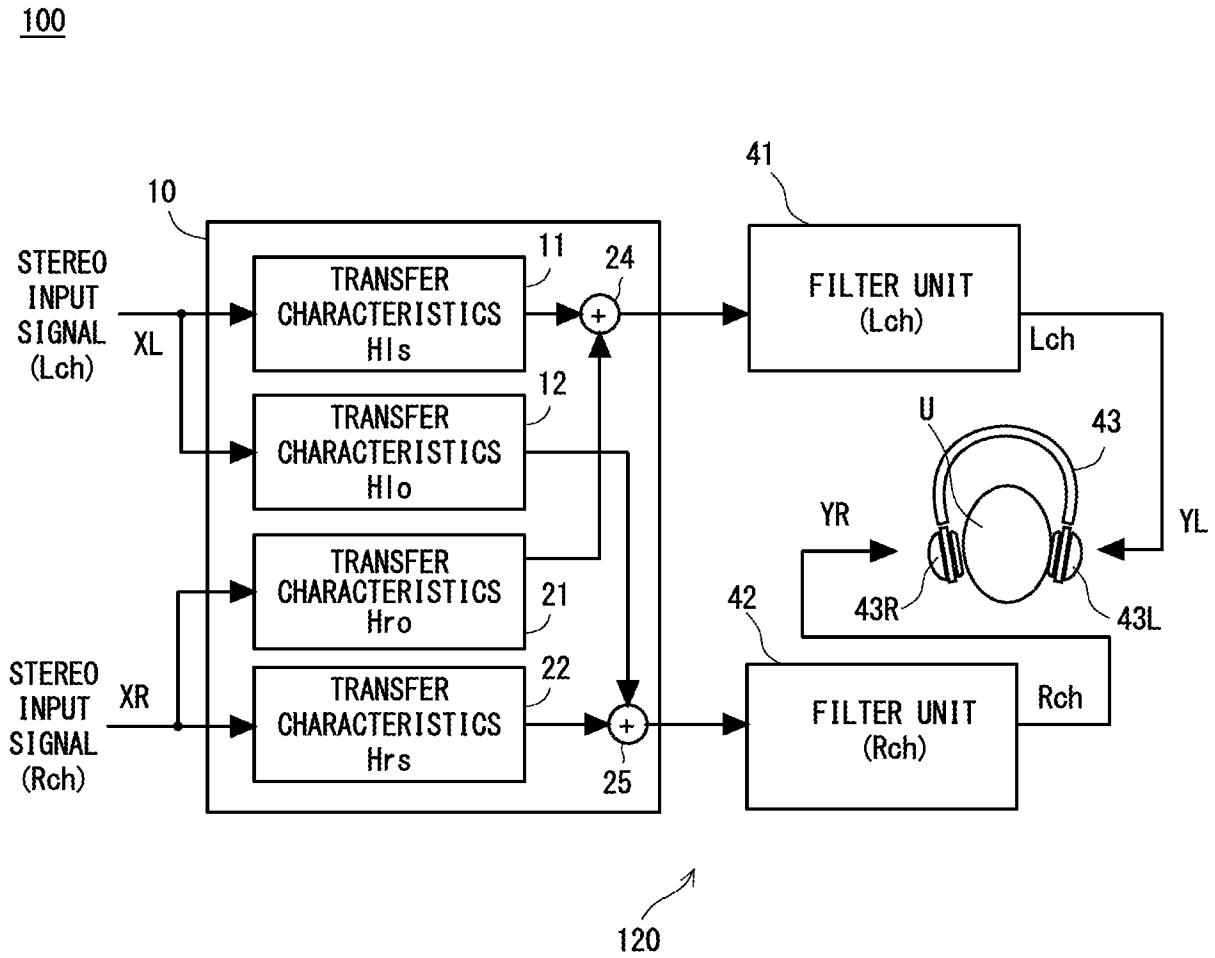
FIG. 1 is a block diagram showing an out-of-head localization device according to an embodiment.

The overview of a sound localization process is described hereinafter. Out-of-head localization, which is an example of a sound localization device, is described in the following example. The out-of-head localization process according to this embodiment performs out-of-head localization by using spatial acoustic transfer characteristics and ear canal transfer characteristics. The spatial acoustic transfer characteristics are transfer characteristics from a sound source such as speakers to the ear canal. The ear canal transfer characteristics are transfer characteristics from the entrance of the ear canal to the eardrum. In this embodiment, out-of-head localization is implemented by measuring the ear canal transfer characteristics when headphones are worn and using this measurement data.

Out-of-head localization according to this embodiment is performed by a user terminal such as a personal computer, a smart phone, or a tablet PC. The user terminal is an information processor including a processing means such as a processor, a storage means such as a memory or a hard disk, a display means such as a liquid crystal monitor, and an input means such as a touch panel, a button, a keyboard and a mouse. The user terminal has a communication function to transmit and receive data. Further, an output means (output unit) with headphones or earphones is connected to the user terminal.

To obtain high localization effect, it is necessary to measure the characteristics of a user and generate an out-of-head localization filter. The spatial acoustic transfer characteristics of an individual user are generally measured in a listening room where an acoustic device such as speakers and room acoustic characteristics are in good condition. Thus, a user needs to go to a listening room or install a listening room in the user's home or the like. Therefore, there are cases where the spatial acoustic transfer characteristics of an individual user cannot be measured appropriately.

Further, even when a listening room is installed by placing speakers in a user's home or the like, there are cases where the speakers are placed in an asymmetric position or the acoustic environment of the room is not appropriate for listening to music. In such cases, it is extremely difficult to measure appropriate spatial acoustic transfer characteristics at home.

On the other hand, measurement of the ear canal transfer characteristics of an individual user is performed with a microphone unit and headphones being worn. In other words, the ear canal transfer characteristics can be measured as long as a user is wearing a microphone unit and headphones. Thus, a user does not need to go to a listening room or install a large-scale listening room in a user's home. Further, generation of measurement signals for measuring the ear canal transfer characteristics, recording of sound pickup signals and the like can be done using a user terminal such as a smartphone or a personal computer.

As described above, there are cases where it is difficult to carry out measurement of the spatial acoustic transfer characteristics on an individual user. In view of the above, an out-of-head localization system according to this embodiment determines a filter in accordance with the spatial acoustic transfer characteristics based on measurement results of the ear canal transfer characteristics. Specifically, this system determines an out-of-head localization filter suitable for a user based on measurement results of the ear canal transfer characteristics of an individual user.

To be specific, an out-of-head localization system includes a user terminal and a server device. The server device stores the spatial acoustic transfer characteristics and the ear canal transfer characteristics measured in advance on a plurality of persons being measured other than a user. Specifically, measurement of the spatial acoustic transfer characteristics using speakers as a sound source (which is hereinafter referred to also as first pre-measurement) and measurement of the ear canal transfer characteristics using headphones (which is hereinafter referred to also as second pre-measurement) are performed by using a measurement device different from a user terminal. The first pre-measurement and the second pre-measurement are performed on persons being measured other than a user.

The server device stores first preset data in accordance with results of the first pre-measurement and second preset data in accordance with results of the second pre-measurement. As a result of performing the first and second pre-measurement on a plurality of persons being measured, a plurality of first preset data and a plurality of second preset data are acquired. The server device then stores the first preset data related to the spatial acoustic transfer characteristics and the second preset data related to the ear canal transfer characteristics in association with each person being measured. The server device stores a plurality of first preset data and a plurality of second preset data in a database.

Further, for an individual user on which out-of-head localization is to be performed, only the ear canal transfer characteristics are measured by using a user terminal (which is described hereinafter as user measurement). The user measurement is measurement using headphones as a sound source, just like the second pre-measurement. The user terminal acquires measurement data related to the ear canal transfer characteristics. The user terminal then transmits user data based on the measurement data to the server device. The server device compares the user data with the plurality of second preset data. Based on a comparison result, the server device determines second present data having a strong correlation to the user data from the plurality of second preset data.

Then, the server device reads the first present data associated with the second present data having a strong correlation. In other words, the server device extracts the first preset data suitable for an individual user from the plurality of first preset data based on a comparison result. The server device transmits the extracted first preset data to the user terminal. Then, the user terminal performs out-of-head localization based on a filter based on the first preset data and an inverse filter based on the user measurement.

(Out-of-Head Localization Device)

FIG. 1 shows an out-of-head localization device 100, which is an example of a sound field reproduction device according to this embodiment. FIG. 1 is a block diagram of the out-of-head localization device 100. The out-of-head localization device 100 reproduces sound fields for a user U who is wearing headphones 43. Thus, the out-of-head localization device 100 performs sound localization for L-ch and R-ch stereo input signals XL and XR. The L-ch and R-ch stereo input signals XL and XR are analog audio reproduced signals that are output from a CD (Compact Disc) player or the like or digital audio data such as mp3 (MPEG Audio Layer-3). Note that the out-of-head localization device 100 is not limited to a physically single device, and a part of processing may be performed in a different device. For example, a part of processing may be performed by a personal computer or the like, and the rest of processing may be performed by a DSP (Digital Signal Processor) included in the headphones 43 or the like.

The out-of-head localization device 100 includes an out-of-head localization unit 10, a filter unit 41, a filter unit 42, and headphones 43. The out-of-head localization unit 10, the filter unit 41 and the filter unit 42 constitute an arithmetic processing unit 120, which is described later, and they can be implemented by a processor or the like, to be specific.

The out-of-head localization unit 10 includes convolution calculation units 11 to 12 and 21 to 22, and adders 24 and 25. The convolution calculation units 11 to 12 and 21 to 22 perform convolution processing using the spatial acoustic transfer characteristics. The stereo input signals XL and XR from a CD player or the like are input to the out-of-head localization unit 10. The spatial acoustic transfer characteristics are set to the out-of-head localization unit 10. The out-of-head localization unit 10 convolves a filter of the spatial acoustic transfer characteristics (which is referred hereinafter also as a spatial acoustic filter) into each of the stereo input signals XL and XR having the respective channels. The spatial acoustic transfer characteristics may be a head-related transfer function HRTF measured in the head or auricle of a measured person, or may be the head-related transfer function of a dummy head or a third person.

The spatial acoustic transfer function is a set of four spatial acoustic transfer characteristics Hls, Hlo, Hro and Hrs. Data used for convolution in the convolution calculation units 11 to 12 and 21 to 22 is a spatial acoustic filter. Each of the spatial acoustic transfer characteristics Hls, Hlo, Hro and Hrs is measured using a measurement device, which is described later.

The convolution calculation unit 11 convolves the spatial acoustic filter in accordance with the spatial acoustic transfer characteristics Hls to the L-ch stereo input signal XL. The convolution calculation unit 11 outputs convolution calculation data to the adder 24. The convolution calculation unit 21 convolves the spatial acoustic filter in accordance with the spatial acoustic transfer characteristics Hro to the R-ch stereo input signal XR. The convolution calculation unit 21 outputs convolution calculation data to the adder 24. The adder 24 adds the two convolution calculation data and outputs the data to the filter unit 41.

The convolution calculation unit 12 convolves the spatial acoustic filter in accordance with the spatial acoustic transfer characteristics Hlo to the L-ch stereo input signal XL. The convolution calculation unit 12 outputs convolution calculation data to the adder 25. The convolution calculation unit 22 convolves the spatial acoustic filter in accordance with the spatial acoustic transfer characteristics Hrs to the R-ch stereo input signal XR. The convolution calculation unit 22 outputs convolution calculation data to the adder 25. The adder 25 adds the two convolution calculation data and outputs the data to the filter unit 42.

An inverse filter that cancels out the headphone characteristics (characteristics between a reproduction unit of headphones and a microphone) is set to the filter units 41 and 42. Then, the inverse filter is convolved to the reproduced signals (convolution calculation signals) on which processing in the out-of-head localization unit 10 has been performed. The filter unit 41 convolves the inverse filter to the L-ch signal from the adder 24. Likewise, the filter unit 42 convolves the inverse filter to the R-ch signal from the adder 25. The inverse filter cancels out the characteristics from the headphone unit to the microphone when the headphones 43 are worn. The microphone may be placed at any position between the entrance of the ear canal and the eardrum. The inverse filter is calculated from a result of measuring the characteristics of the user U.

The filter unit 41 outputs the processed L-ch signal to a left unit 43L of the headphones 43. The filter unit 42 outputs the processed R-ch signal to a right unit 43R of the headphones 43. The user U is wearing the headphones 43. The headphones 43 output the L-ch signal and the R-ch signal toward the user U. It is thereby possible to reproduce sound images localized outside the head of the user U.

As described above, the out-of-head localization device 100 performs out-of-head localization by using the spatial acoustic filters in accordance with the spatial acoustic transfer characteristics Hls, Hlo, Hro and Hrs and the inverse filters of the headphone characteristics. In the following description, the spatial acoustic filters in accordance with the spatial acoustic transfer characteristics Hls, Hlo, Hro and Hrs and the inverse filter of the headphone characteristics are referred to collectively as an out-of-head localization filter. In the case of 2ch stereo reproduced signals, the out-of-head localization filter is composed of four spatial acoustic filters and two inverse filters. The out-of-head localization device 100 then carries out convolution calculation on the stereo reproduced signals by using the total six out-of-head localization filters and thereby performs out-of-head localization.

(Measurement Device of Spatial Acoustic Transfer Characteristics)

Figure 2:
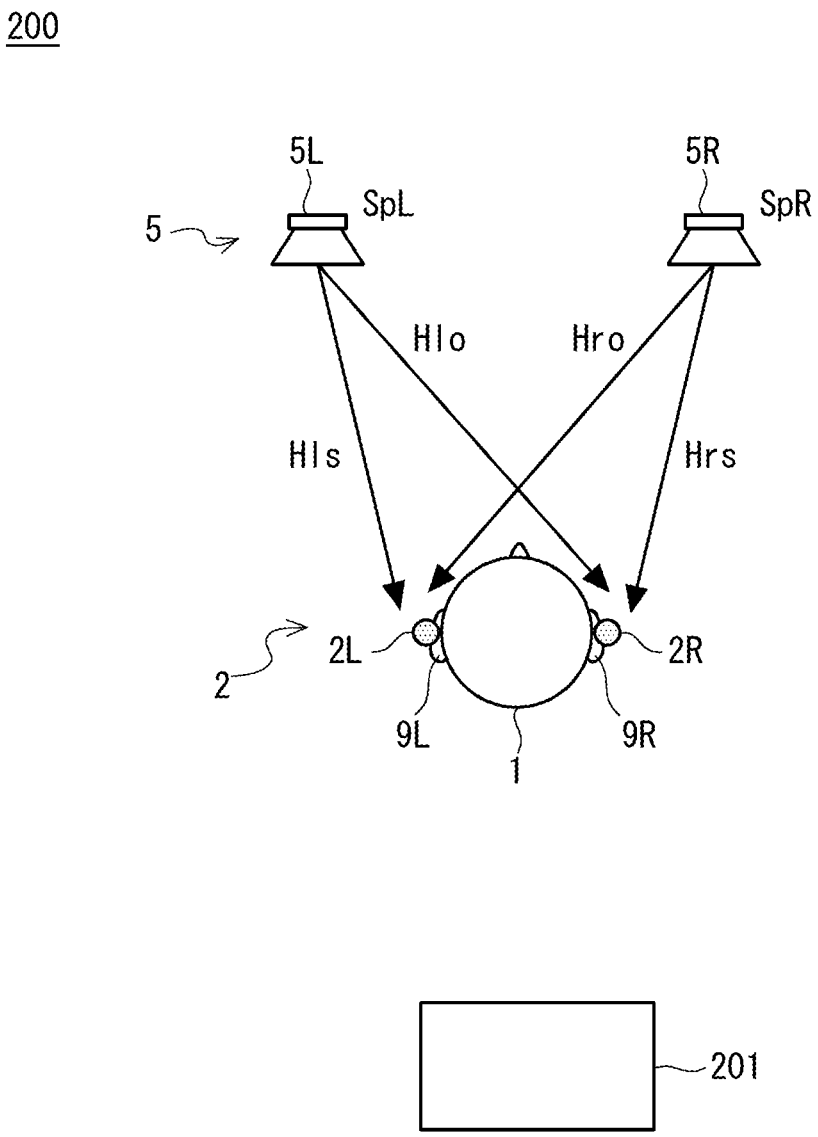
FIG. 2 is a view showing the structure of a measurement device for measuring spatial acoustic transfer characteristics.

A measurement device 200 for measuring the spatial acoustic transfer characteristics Hls, Hlo, Hro and Hrs is described hereinafter with reference to FIG. 2. FIG. 2 is a view schematically showing a measurement structure for performing the first pre-measurement on a person 1 being measured.

As shown in FIG. 2, the measurement device 200 includes a stereo speaker 5 and a microphone unit 2. The stereo speaker 5 is placed in a measurement environment. The measurement environment may be the user U's room at home, a dealer or showroom of an audio system or the like. The measurement environment is preferably a listening room where speakers and acoustics are in good condition.

In this embodiment, a processor 201 of the filter generation device 200 performs processing for appropriately generating the spatial acoustic filter. The processor 201 includes a music player such as a CD player, for example. The processor 201 may be a personal computer (PC), a tablet terminal, a smart phone or the like. Further, the processor 201 may be a server device.

The stereo speaker 5 includes a left speaker 5L and a right speaker 5R. For example, the left speaker 5L and the right speaker 5R are placed in front of the person 1 being measured. The left speaker 5L and the right speaker 5R output impulse sounds for impulse response measurement and the like. Although the number of speakers, which serve as sound sources, is 2 (stereo speakers) in this embodiment, the number of sound sources to be used for measurement is not limited to 2, and it may be 1 or more. Therefore, this embodiment is applicable also to 1ch mono or 5.1ch, 7.1ch etc. multichannel environment.

The microphone unit 2 is stereo microphones including a left microphone 2L and a right microphone 2R. The left microphone 2L is placed on a left ear 9L of the person 1 being measured, and the right microphone 2R is placed on a right ear 9R of the person 1 being measured. To be specific, the microphones 2L and 2R are preferably placed at a position between the entrance of the ear canal and the eardrum of the left ear 9L and the right ear 9R, respectively. The microphones 2L and 2R pick up measurement signals output from the stereo speaker 5 and acquire sound pickup signals. The microphones 2L and 2R output the sound pickup signals to the processor 201. The person 1 being measured may be a person or a dummy head. In other words, in this embodiment, the person 1 being measured is a concept that includes not only a person but also a dummy head.

As described above, impulse sounds output from the left and right speakers 5L and 5R are measured using the microphones 2L and 2R, respectively, and thereby impulse response is measured. The processor 201 stores the sound pickup signals acquired by the impulse response measurement into a memory or the like. The spatial acoustic transfer characteristics Hls between the left speaker 5L and the left microphone 2L, the spatial acoustic transfer characteristics Hlo between the left speaker 5L and the right microphone 2R, the spatial acoustic transfer characteristics Hro between the right speaker 5R and the left microphone 2L, and the spatial acoustic transfer characteristics Hrs between the right speaker 5R and the right microphone 2R are thereby measured. Specifically, the left microphone 2L picks up the measurement signal that is output from the left speaker 5L, and thereby the spatial acoustic transfer characteristics Hls are acquired. The right microphone 2R picks up the measurement signal that is output from the left speaker 5L, and thereby the spatial acoustic transfer characteristics Hlo are acquired. The left microphone 2L picks up the measurement signal that is output from the right speaker 5R, and thereby the spatial acoustic transfer characteristics Hro are acquired. The right microphone 2R picks up the measurement signal that is output from the right speaker 5R, and thereby the spatial acoustic transfer characteristics Hrs are acquired.

Further, the measurement device 200 may generate the spatial acoustic filters in accordance with the spatial acoustic transfer characteristics Hls, Hlo, Hro and Hrs from the left and right speakers 5L and 5R to the left and right microphones 2L and 2R based on the sound pickup signals. For example, the processor 201 cuts out the spatial acoustic transfer characteristics Hls, Hlo, Hro and Hrs with a specified filter length. The processor 201 may correct the measured spatial acoustic transfer characteristics Hls, Hlo, Hro and Hrs.

In this manner, the processor 201 generates the spatial acoustic filter to be used for convolution calculation of the out-of-head localization device 100. As shown in FIG. 1, the out-of-head localization device 100 performs out-of-head localization by using the spatial acoustic filters in accordance with the spatial acoustic transfer characteristics Hls, Hlo, Hro and Hrs between the left and right speakers 5L and 5R and the left and right microphones 2L and 2R. Specifically, the out-of-head localization is performed by convolving the spatial acoustic filters to the audio reproduced signals.

The processor 201 performs the same processing on the sound pickup signal corresponding to each of the spatial acoustic transfer characteristics Hls, Hlo, Hro and Hrs. Specifically, the same processing is performed on each of the four sound pickup signals corresponding to the spatial acoustic transfer characteristics Hls, Hlo, Hro and Hrs. The spatial acoustic filters respectively corresponding to the spatial acoustic transfer characteristics Hls, Hlo, Hro and Hrs are thereby generated.

(Measurement of Ear Canal Transfer Characteristics)

Figure 3:
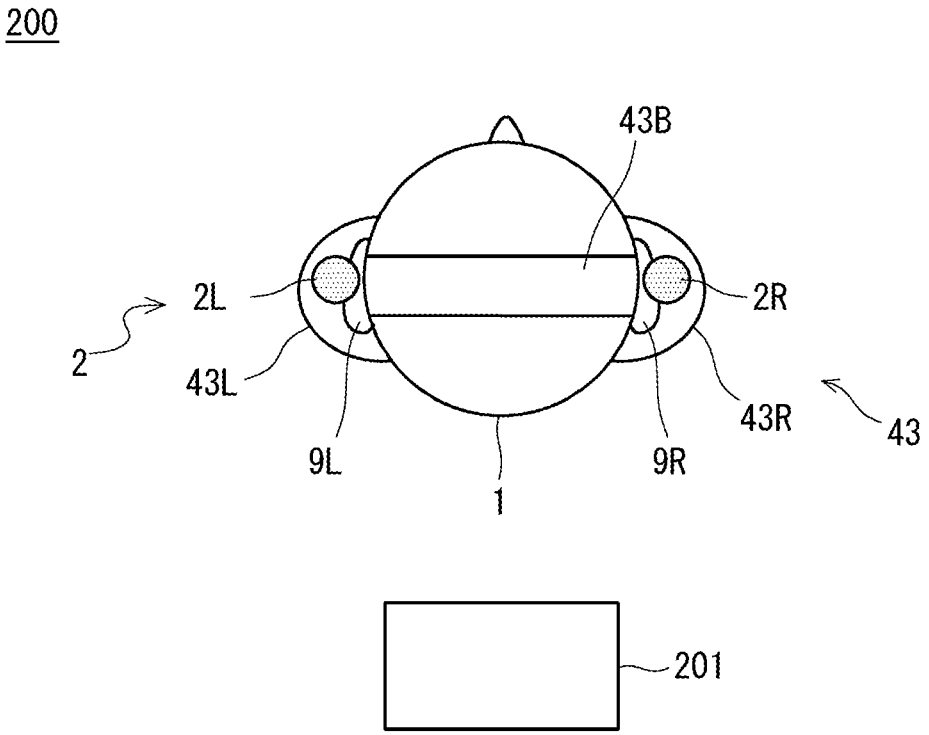
FIG. 3 is a view showing the structure of a measurement device for measuring ear canal transfer characteristics.

A measurement device 200 for measuring the ear canal transfer characteristics is described hereinafter with reference to FIG. 3. FIG. 3 shows a structure for performing the second pre-measurement on a person 1 being measured.

A microphone unit 2 and headphones 43 are connected to a processor 201. The microphone unit 2 includes a left microphone 2L and a right microphone 2R. The left microphone 2L is worn on a left ear 9L of the person 1 being measured, and the right microphone 2R is worn on a right ear 9R of the person 1 being measured. The processor 201 and the microphone unit 2 may be the same as or different from the processor 201 and the microphone unit 2 in FIG. 2, respectively.

The headphones 43 include a headphone band 43B, a left unit 43L, and a right unit 43R. The headphone band 43B connects the left unit 43L and the right unit 43R. The left unit 43L outputs a sound toward the left ear 9L of the person 1 being measured. The right unit 43R outputs a sound toward the right ear 9R of the person 1 being measured. The type of the headphones 43 may be closed, open, semi-open, semi-closed or any other type. The headphones 43 are worn on the person 1 being measured while the microphone unit 2 is worn on this person. Specifically, the left unit 43L and the right unit 43R of the headphones 43 are worn on the left ear 9L and the right ear 9R on which the left microphone 2L and the right microphone 2R are worn, respectively. The headphone band 43B generates an urging force to press the left unit 43L and the right unit 43R against the left ear 9L and the right ear 9R, respectively.

The left microphone 2L picks up the sound output from the left unit 43L of the headphones 43. The right microphone 2R picks up the sound output from the right unit 43R of the headphones 43. A microphone part of each of the left microphone 2L and the right microphone 2R is placed at a sound pickup position near the external acoustic opening. The left microphone 2L and the right microphone 2R are formed not to interfere with the headphones 43. Specifically, the person 1 being measured can wear the headphones 43 in the state where the left microphone 2L and the right microphone 2R are placed at appropriate positions of the left ear 9L and the right ear 9R, respectively.

The processor 201 outputs measurement signals to the left microphone 2L and the right microphone 2R. The left microphone 2L and the right microphone 2R thereby generate impulse sounds or the like. To be specific, an impulse sound output from the left unit 43L is measured by the left microphone 2L. An impulse sound output from the right unit 43R is measured by the right microphone 2R. Impulse response measurement is performed in this manner.

The processor 201 stores the sound pickup signals acquired based on the impulse response measurement into a memory or the like. The transfer characteristics between the left unit 43L and the left microphone 2L (which is the ear canal transfer characteristics of the left ear) and the transfer characteristics between the right unit 43R and the right microphone 2R (which is the ear canal transfer characteristics of the right ear) are thereby acquired. Measurement data of the ear canal transfer characteristics of the left ear acquired by the left microphone 2L is referred to as measurement data ECTFL, and measurement data of the ear canal transfer characteristics of the right ear acquired by the right microphone 2R is referred to as measurement data ECTFR. Measurement data of the ear canal transfer characteristics of the both ears is referred to as measurement data ECTF.

The processor 201 includes a memory or the like that stores the measurement data ECTFL and ECTFR. Note that the processor 201 generates an impulse signal, a TSP (Time Stretched Pule) signal or the like as the measurement signal for measuring the ear canal transfer characteristics and the spatial acoustic transfer characteristics. The measurement signal contains a measurement sound such as an impulse sound.

By the measurement devices 200 shown in FIGS. 2 and 3, the ear canal transfer characteristics and the spatial acoustic transfer characteristics of a plurality of persons 1 being measured are measured. In this embodiment, the first pre-measurement by the measurement structure in FIG. 2 is performed on a plurality of persons 1 being measured. Likewise, the second pre-measurement by the measurement structure in FIG. 3 is performed on the plurality of persons 1 being measured. The ear canal transfer characteristics and the spatial acoustic transfer characteristics are thereby measured for each of the persons 1 being measured.

(Out-of-Head Localization Filter Determination System)

Figure 4:
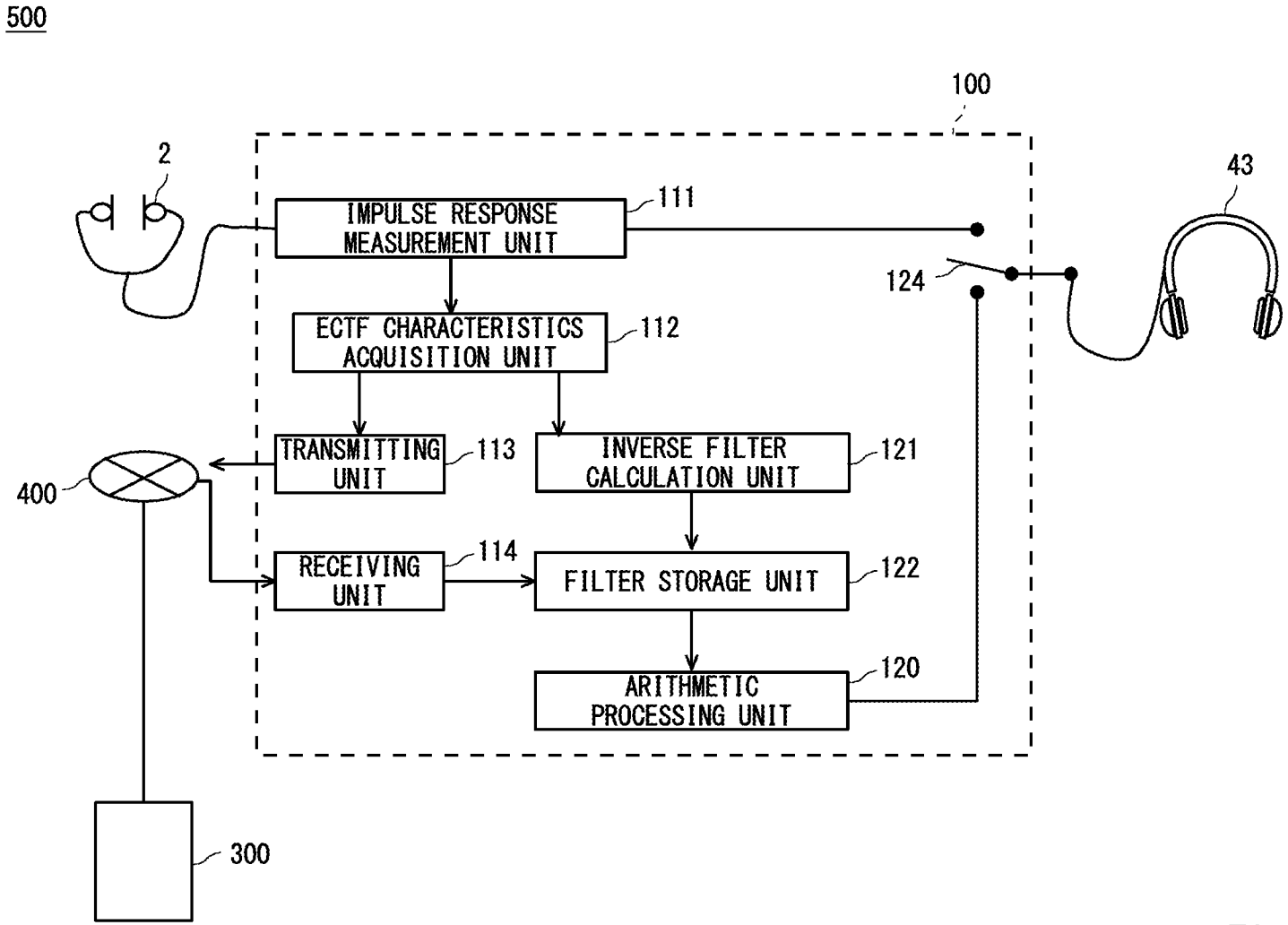
FIG. 4 is a view showing the overall structure of an out-of-head localization filter determination system according to this embodiment.

An out-of-head localization filter determination system 500 according to this embodiment is described hereinafter with reference to FIG. 4. FIG. 4 is a view showing the overall structure of the out-of-head localization filter determination system 500. The out-of-head localization filter determination system 500 includes a microphone unit 2, headphones 43, an out-of-head localization device 100, and a server device 300.

The out-of-head localization device 100 and the server device 300 are connected through a network 400. The network 400 is a public network such as the Internet or a mobile phone communication network, for example. The out-of-head localization device 100 and the server device 300 can communicate with each other by wireless or wired. Note that the out-of-head localization device 100 and the server device 300 may be an integral device.

The out-of-head localization device 100 is a user terminal that outputs a reproduced signal on which out-of-head localization has been performed to a user U, as shown in FIG. 1. Further, the out-of-head localization device 100 performs measurement of the ear canal transfer characteristics of the user U. The microphone unit 2 and the headphones 43 are connected to the out-of-head localization device 100. The out-of-head localization device 100 performs impulse response measurement using the microphone unit 2 and the headphones 43, just like the measurement device 200 in FIG. 3. Note that the out-of-head localization device 100 may be connected to the microphone unit 2 and the headphones 43 wirelessly by Bluetooth (registered trademark) or the like.

The out-of-head localization device 100 includes an impulse response measurement unit 111, an ECTF characteristics acquisition unit 112, a transmitting unit 113, a receiving unit 114, an arithmetic processing unit 120, an inverse filter calculation unit 121, a filter storage unit 122, and a switch 124. Note that, when the out-of-head localization device 100 and the server device 300 are an integral device, this device may include an acquisition unit that acquires user data, instead of the receiving unit 114.

The switch 124 switches user measurement and out-of-head localization reproduction. Specifically, for user measurement, the switch 124 connects the headphones 43 to the impulse response measurement unit 111. For out-of-head localization reproduction, the switch 124 connects the headphones 43 to the arithmetic processing unit 120.

The impulse response measurement unit 111 outputs a measurement signal, which is an impulse sound, to the headphones 43 in order to perform user measurement. The microphone unit 2 picks up the impulse sound output from the headphones 43. The microphone unit 2 outputs the sound pickup signal to the impulse response measurement unit 111. The impulse sound measurement is the same as described with reference to FIG. 3, and the description thereof is omitted as appropriate. In other words, the out-of-head localization device 100 has the same functions as the processor 201 in FIG. 3. The impulse response measurement unit 111, which serves as a measurement device for the out-of-head localization device 100, the microphone unit 2 and the headphones 43 to perform user measurement, may perform A/D conversion, synchronous addition and the like of the sound pickup signals.

By the impulse response measurement, the impulse response measurement unit 111 acquires the measurement data ECTF related to the ear canal transfer characteristics. The measurement data ECTF contains measurement data ECTFL related to the ear canal transfer characteristics of the left ear 9L of the user U and the measurement data ECTFR related to the ear canal transfer characteristics of the right ear 9R of the user U.

The ECTF characteristics acquisition unit 112 performs specified processing on the measurement data ECTFL and ECTFR and thereby acquires the characteristics of the measurement data ECTFL and ECTFR. For example, the ECTF characteristics acquisition unit 112 calculates frequency-amplitude characteristics and frequency-phase characteristics by performing discrete Fourier transform. The ECTF characteristics acquisition unit 112 may calculate frequency-amplitude characteristics and frequency-phase characteristics by performing cosine transform or the like, not limited to discrete Fourier transform. Instead of the frequency-amplitude characteristics, frequency-power characteristics may be used.

Further, the ECTF characteristics acquisition unit 112 acquires a feature quantity (feature vector) of the measurement data ECTF based on the frequency-amplitude characteristics. The feature quantity of the measurement data ECTFL is referred to as a feature quantity hpL, and the feature quantity of the measurement data ECTFR is referred to as a feature quantity hpR. The feature quantity hpL represents a feature in the left ear of the user U, and the feature quantity hpR represents a feature in the right ear of the user U.

For example, the feature quantities hpL and hpR are the frequency-amplitude characteristics at 2 kHz to 20 kHz. Specifically, the frequency-amplitude characteristics in a partial frequency band are the feature quantities hpL and hpR, respectively. The feature quantities hpL and hpR are feature vectors where an amplitude value in the frequency domain of the ear canal transfer characteristics is a feature parameter. The feature quantities hpL and hpR are in multidimensional vector form with the same number of dimensions. Further, the feature quantities hpL and hpR may be data obtained by smoothing the frequency-amplitude characteristics at 2 kHz to 20 kHz.

A frequency band to be extracted is not limited to 2 kHz to 24 kHz as a matter of course. For example, it may be a frequency band of 1 kHz to 16 kHz, or a frequency band of 1 kHz to 24 kHz. The feature quantities hpL and hpR preferably contain the frequency-amplitude characteristics at 1 kHz or higher and more preferably contain the frequency-amplitude characteristics at 2 kHz or higher. Further, data obtained by smoothing the frequency-amplitude characteristics may be used as the feature quantity.

The inverse filter calculation unit 121 calculates an inverse filter based on the characteristics of the measurement data ECTF. For example, the inverse filter calculation unit 121 corrects the frequency-amplitude characteristics and the frequency-phase characteristics of the measurement data ECTF. The inverse filter calculation unit 121 calculates a temporal signal by using frequency characteristics and phase characteristics by inverse discrete Fourier transform. The inverse filter calculation unit 121 calculates an inverse filter by cutting out the temporal signal with a specified filter length.

As described above, the inverse filter is an filter that cancels out headphone characteristics (characteristics between a reproduction unit of headphones and a microphone). The filter storage unit 122 stores left and right inverse filters calculated by the inverse filter calculation unit 121. Note that a known technique can be used for calculating an inverse filter, and therefore a method of calculating an inverse filter is not described in detail.

The transmitting unit 113 transmits, as user data, the feature quantities calculated by the ECTF characteristics acquisition unit 112 to the server device 300. The transmitting unit 113 performs processing (for example, modulation) in accordance with a communication standard on the user data and transmits this data. Note that the user data may be data based on the user measurement. Note that the feature quantities hpL and hpR of the user U transmitted from the transmitting unit 113 are referred to as feature quantities hpL_U and hpR_U, respectively.

Figure 5:
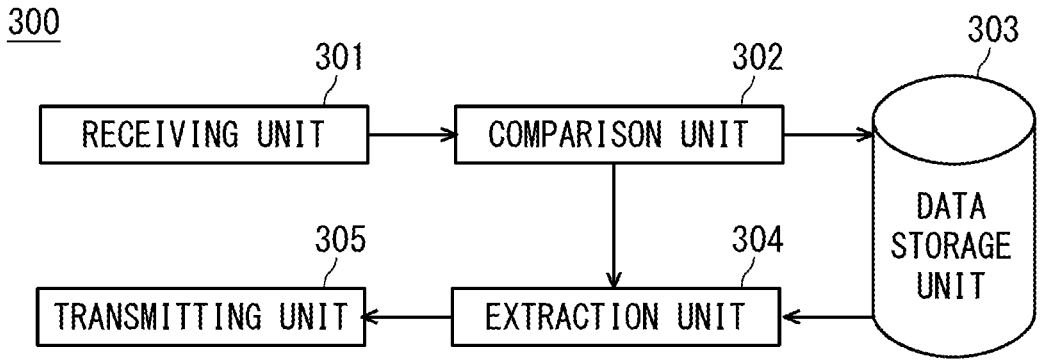
FIG. 5 is a view showing the structure of a server device in the out-of-head localization filter determination system.

The structure of the server device 300 is described hereinafter with reference to FIG. 5. FIG. 5 is a block diagram showing a control structure of the server device 300. The server device 300 includes a receiving unit 301, a comparison unit 302, a data storage unit 303, an extraction unit 304, and a transmitting unit 305. The server device 300 serves as a filter determination device that determines the spatial acoustic filter based on the feature quantity. Note that, when the out-of-head localization device 100 and the server device 300 are an integral device, this device does not need to include the transmitting unit 305.

The server device 300 is a computer including a processor, a memory and the like, and performs the following processing according to a program. Further, the server device 300 is not limited to a single device, and it may be implemented by combining two or more devices, or may be a virtual server such as a cloud server. The data storage unit that stores data, and the comparison unit 302 and the extraction unit 304 that perform data processing may be physically separate devices.

The receiving unit 301 receives the feature quantities hpL_U and hpR_U transmitted from the out-of-head localization device 100. The receiving unit 301 performs processing (for example, demodulation) in accordance with a communication standard on the received user data. The comparison unit 302 compares the feature quantities hpL_U and hpR_U with the preset data stored in the data storage unit 303.

The data storage unit 303 is a database that stores, as preset data, data related to a plurality of persons being measured obtained by pre-measurement. The data stored in the data storage unit 303 is described hereinafter with reference to FIG. 6. FIG. 6 is a table showing the data stored in the data storage unit 303.

The data storage unit 303 stores preset data for each of the left and right ears of a person being measured. To be specific, the data storage unit 303 is in table format where ID of person being measured, left/right of ear, feature quantity, spatial acoustic transfer characteristics 1, and spatial acoustic transfer characteristics 2 are arranged in one row. Note that the data format shown in FIG. 6 is an example, and a data format where objects of each parameter are stored in association by tag or the like may be used instead of the table format.

Two data sets are stored for one person A being measured in the data storage unit 303. Specifically, a data set related to the left ear of the person A being measured and a data set related to the right ear of the person A being measured are stored in the data storage unit 303.

One data set contains ID of person being measured, left/right of ear, feature quantity, spatial acoustic transfer characteristics 1, and spatial acoustic transfer characteristics 2. The feature quantity is data based on the second pre-measurement by the measurement device 200 shown in FIG. 3. The feature quantity is data that is the same as the feature quantity acquired by the ECTF characteristics acquisition unit 112. For example, the feature quantity is frequency-amplitude characteristics at 2 kHz to 20 kHz of the ear canal transfer characteristics. When the user data is data obtained by smoothing the frequency-amplitude characteristics, the feature quantity is also data obtained by smoothing the frequency-amplitude characteristics. The feature quantity of the left ear of the person A being measured is indicated as a feature quantity hpL_A, and the feature quantity of the right ear of the person A being measured is indicated as a feature quantity hpR_A. The feature quantity of the left ear of the person B being measured is indicated as a feature quantity hpL_B, and the feature quantity of the right ear of the person B being measured is indicated as a feature quantity hpR_B.

The spatial acoustic transfer characteristics 1 and the spatial acoustic transfer characteristics 2 are data based on the first pre-measurement by the measurement device 200 shown in FIG. 2. In the case of the left ear of the person A being measured, the spatial acoustic transfer characteristics 1 are Hls_A, and the spatial acoustic transfer characteristics 2 are Hro_A. In the case of the right ear of the person A being measured, the spatial acoustic transfer characteristics 1 are Hrs_A, and the spatial acoustic transfer characteristics 2 are Hlo_A. In this manner, two spatial acoustic transfer characteristics for one ear are paired. For the left ear of the person B being measured, Hls_B and Hro_B are paired, and for the right ear of the person B being measured, Hrs_B and Hlo_B are paired. The spatial acoustic transfer characteristics 1 and the spatial acoustic transfer characteristics 2 may be data after being cut out with a filter length, or may be data before being cut out with a filter length.

For the left ear of the person A being measured, the feature quantity hpL_A, the spatial acoustic transfer characteristics Hls_A, and the spatial acoustic transfer characteristics Hro_A are associated as one data set. Likewise, for the right ear of the person A being measured, the feature quantity hpR_A, the spatial acoustic transfer characteristics Hrs_A, and the spatial acoustic transfer characteristics Hlo_A are associated as one data set. Likewise, for the left ear of the person B being measured, the feature quantity hpL_B, the spatial acoustic transfer characteristics Hls_B, and the spatial acoustic transfer characteristics Hro_B are associated as one data set. Likewise, for the right ear of the person B being measured, the feature quantity hpR_B, the spatial acoustic transfer characteristics Hrs_B, and the spatial acoustic transfer characteristics Hlo_B are associated as one data set.

Note that a pair of the spatial acoustic transfer characteristics 1 and 2 is the first preset data. Specifically, the spatial acoustic transfer characteristics 1 and the spatial acoustic transfer characteristics 2 that form one data set is the first preset data. The feature quantity is the second preset data. The feature quantity that forms one data set is the second preset data. One data set contains the first preset data and the second preset data. The data storage unit 303 stores the first preset data and the second preset data in association with each of the left and right ears of a person being measured.

It is assumed that the first and second pre-measurement is previously performed for n (n is an integer of 2 or more) number of persons 1 being measured. In this case, 2n number of data sets, which are data sets for both ears, are stored in the data storage unit 303. The feature quantities stored in the data storage unit 303 are indicated as the feature quantities hpL_A to hpL_N and hpR_A to hpR_N. The feature quantities hpL_A to hpL_N are feature vectors extracted from the ear canal transfer characteristics related to the left ears of the persons A to N being measured. The feature quantities hpR_A to hpR_N are feature vectors extracted from the ear canal transfer characteristics related to the right ears of the persons A to N being measured.

The comparison unit 302 compares the feature quantity hpL_U with each of the feature quantities hpL_A to hpL_N and hpR_A to hpR_N. The comparison unit 302 then selects one that is most similar to the feature quantity hpL_U from the 2n number of feature quantities hpL_A to hpL_N and hpR_A to hpR_N. In this example, a correlation between two feature quantities is calculated as a similarity score. The comparison unit 302 selects a data set of the feature quantity with the highest similarity score. Assuming that the left ear of a person 1 being measured is selected, the selected feature quantity hpL is a feature quantity hpL_1.

Likewise, the comparison unit 302 compares the feature quantity hpR_U with each of the feature quantities hpL_A to hpL_N and hpR_A to hpR_N. The comparison unit 302 then selects one that is most similar to the feature quantity hpR_U from the 2n number of feature quantities hpL_A to hpL_N and hpR_A to hpR_N. Assuming that the right ear of a person m being measured is selected, the selected feature quantity is a feature quantity hpR_m.

The comparison unit 302 outputs a comparison result to the extraction unit 304. To be specific, it outputs ID of the person being measured and left/right of the ear of the second preset data with the highest similarity score to the extraction unit 304. The extraction unit 304 extracts the first preset data based on the comparison result.

The extraction unit 304 reads the spatial acoustic transfer characteristics corresponding to the feature quantity hpL_1 from the data storage unit 303. The extraction unit 304 refers to the data storage unit 303 and extracts the spatial acoustic transfer characteristics Hls_1 and the spatial acoustic transfer characteristics Hro_1 of the left ear of the person 1 being measured.

Likewise, the extraction unit 304 reads the spatial acoustic transfer characteristics corresponding to the feature quantity hpR_m from the data storage unit 303. The extraction unit 304 refers to the data storage unit 303 and extracts the spatial acoustic transfer characteristics Hrs_m and the spatial acoustic transfer characteristics Hlo_m of the right ear of the person m being measured.

In this manner, the comparison unit 302 compares user data with a plurality of second preset data. The extraction unit 304 then extracts the first preset data suitable for a user based on a comparison result between the second preset data and the user data.

Then, the transmitting unit 305 transmits the first preset data extracted by the extraction unit 304 to the out-of-head localization device 100. The transmitting unit 305 performs processing (for example, modulation) in accordance with a communication standard on the first preset data and transmits this data. In this example, the spatial acoustic transfer characteristics Hls_1 and the spatial acoustic transfer characteristics Hro_1 are extracted as the first preset data for the left ear, and the spatial acoustic transfer characteristics Hrs_m and the spatial acoustic transfer characteristics Hlo_m are extracted as the first preset data for the right ear. Thus, the transmitting unit 305 transmits the spatial acoustic transfer characteristics Hls_1, the spatial acoustic transfer characteristics Hro_1, the spatial acoustic transfer characteristics Hrs_m and the spatial acoustic transfer characteristics Hlo_m to the out-of-head localization device 100.

Referring back to the description of FIG. 4, the receiving unit 114 receives the first preset data transmitted from the transmitting unit 305. The receiving unit performs processing (for example, demodulation) in accordance with a communication standard on the received first preset data. The receiving unit 114 receives the spatial acoustic transfer characteristics Hls_1 and the spatial acoustic transfer characteristics Hro_1 as the first preset data related to the left ear, and receives the spatial acoustic transfer characteristics Hrs_m and the spatial acoustic transfer characteristics Hlo_m as the first preset data related to the right ear.

Then, the filter storage unit 122 stores the spatial acoustic filter based on the first preset data. Specifically, the spatial acoustic transfer characteristics Hls_1 serves as the spatial acoustic transfer characteristics Hls of the user U, and the spatial acoustic transfer characteristics Hro_1 serves as the spatial acoustic transfer characteristics Hro of the user U. Likewise, the spatial acoustic transfer characteristics Hrs_m serves as the spatial acoustic transfer characteristics Hrs of the user U, and the spatial acoustic transfer characteristics Hlo_m serves as the spatial acoustic transfer characteristics Hlo of the user U.

Note that, when the first preset data is data after being cut out with a filter length, the out-of-head localization device 100 stores the first preset data as the spatial acoustic filter. For example, the spatial acoustic transfer characteristics Hls_1 serves as the spatial acoustic transfer characteristics Hls of the user U. On the other hand, when the first preset data is data before being cut out with a filter length, the out-of-head localization device 100 performs processing of cutting out the spatial acoustic transfer characteristics with a filter length.

The arithmetic processing unit 120 performs processing by using the spatial acoustic filters corresponding to the four spatial acoustic transfer characteristics Hls, Hlo, Hro and Hrs and the inverse filters. The arithmetic processing unit 120 is composed of the out-of-head localization unit 10, the filter unit 41 and the filter unit 42 shown in FIG. 1. Thus, the arithmetic processing unit 120 carries out the above-described convolution calculation or the like on the stereo input signal by using the four spatial acoustic filters and two inverse filters.

As described above, the data storage unit 303 stores the first preset data and the second preset data in association for each person 1 being measured. The first preset data is data related to the spatial acoustic transfer characteristics of the person 1 being measured. The second preset data is data related to the ear canal transfer characteristics of the person 1 being measured.

The comparison unit 302 compares the user data with the second preset data. The user data is data related to the ear canal transfer characteristics obtained by the user measurement. The comparison unit 302 then determines the person 1 being measured similar to the ear canal transfer characteristics of the user and left/right of the ear.

The extraction unit 304 reads the first preset data corresponding to the determined person being measured and left/right of the ear. Then, the transmitting unit 305 transmits the extracted first preset data to the out-of-head localization device 100. The out-of-head localization device 100, which is the user terminal, performs out-of-head localization by using the spatial acoustic filter based on the first preset data and the inverse filter based on the measurement data.

In this manner, it is possible to determine an appropriate filter without the need for the user U to measure the spatial acoustic transfer characteristics. This eliminates the need for the user to go to a listening room or the like or install speakers or the like in the user's home. The user measurement is performed with headphones being worn. Thus, the ear canal transfer characteristics of an individual user can be measured if the user U wears headphones and a microphone. It is thereby possible to achieve out-of-head localization with high localization effect in a simple and convenient way. It is preferred that the headphones 43 used for user measurement and out-of-head localization listening are of the same type.

Further, in a method according to this embodiment, it is not necessary to perform auditory test to listen to a large number of preset characteristics and to measure detailed physical characteristics. It is thereby possible to reduce the burden on a user and enhance the convenience. Particularly, because a high frequency band is significantly affected by individual characteristics, the ECTF characteristics acquisition unit 112 calculates the frequency-amplitude characteristics in a high frequency band where features are likely to appear as the feature quantities hpL and hpR. Then, the feature quantities of a person being measured and a user are compared to thereby select a person being measured having similar characteristics. The extraction unit 304 then extracts the first preset data of the ear of the selected person being measured, and it is thus possible to expect high out-of-head localization effect.

Note that the comparison unit 302 does not necessarily compare the received user data and the stored second preset data directly. Specifically, the comparison unit 302 may perform comparison after carrying out arithmetic processing on at least one of the received user data and the stored second preset data. For example, when the user data and the second preset data are the frequency-amplitude characteristics at 2 kHz to 20 kHz, the comparison unit 302 may perform smoothing on each of the frequency-amplitude characteristics. The comparison unit 302 may then compare the frequency-amplitude characteristics after smoothing.

Alternatively, when the user data is the frequency-amplitude characteristics in the entire frequency band and the second preset data is the frequency-amplitude characteristics in the frequency band of 2 kHz to 20 kHz, the comparison unit 302 may extract the frequency-amplitude characteristics in the frequency band of 2 kHz to 20 kHz from the user data. Then, the comparison unit 302 may compare the extracted frequency-amplitude characteristics. In this manner, the comparison in the comparison unit 302 includes not only directly comparing the user data and the second preset data but also comparing data obtained from the user data and data obtained from the second preset data. Further, by using the feature quantity rather than the actual ear canal transfer characteristics as the second preset data, it is possible to reduce the amount of data. Because it is not necessary to calculate the feature quantity in every comparison, it is possible to reduce the processing load on the server device 300.

Figure 7:
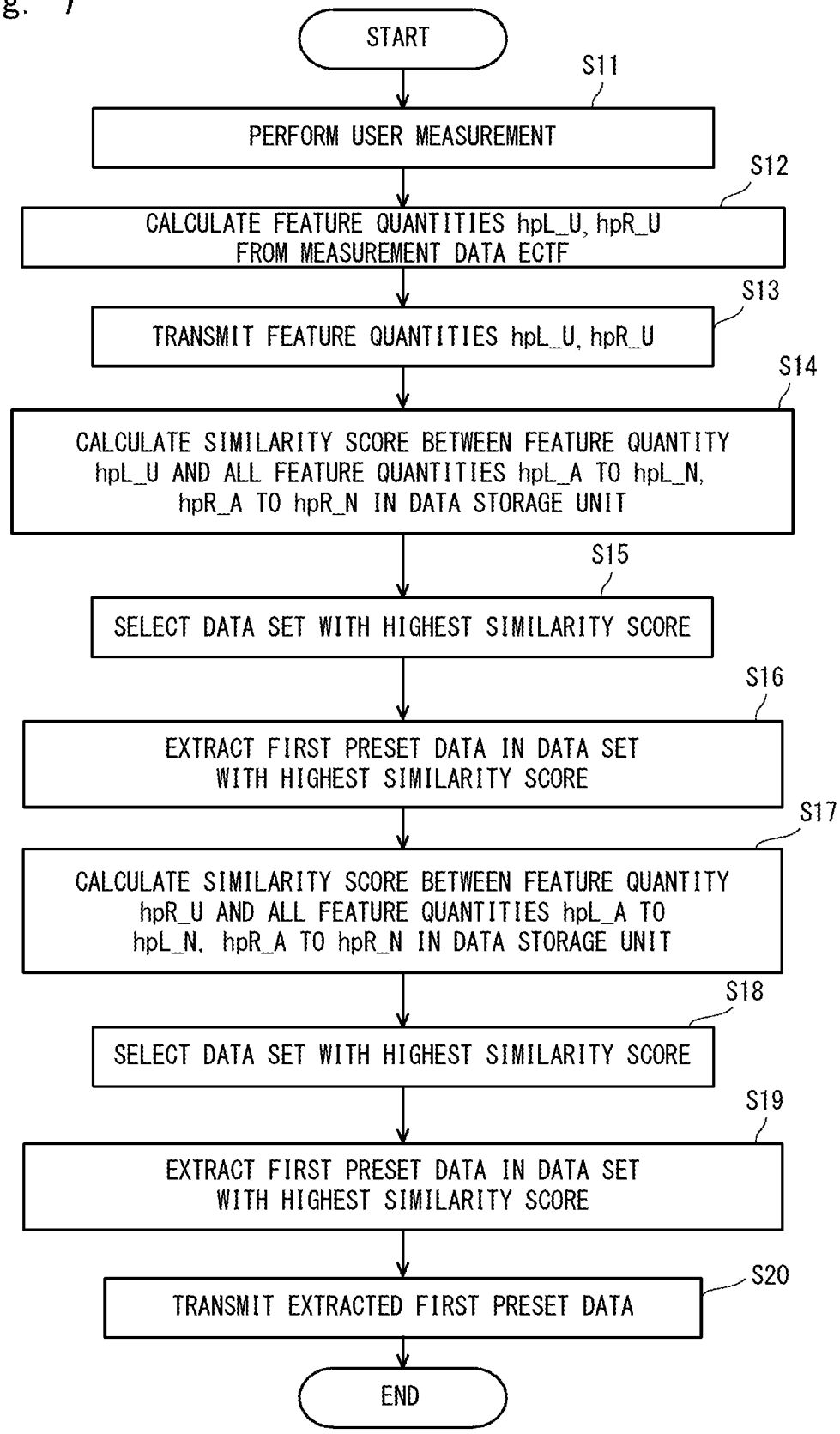
FIG. 7 is a flowchart showing a filter determination method according to this embodiment.

An out-of-head localization filter determination method according to this embodiment is described hereinafter with reference to FIG. 7. FIG. 7 is a flowchart showing the out-of-head localization filter determination method. Note that, prior to implementing the flow shown in FIG. 7, the measurement device 200 performs the first and second pre-measurement. Specifically, the process in FIG. 7 is performed in the state where the data storage unit 303 stores a plurality of data sets.

First, the impulse response measurement unit 111 performs user measurement (S11). The impulse response measurement unit 111 thereby acquires the measurement data ECTFL and ECTFR related to the ear canal transfer characteristics of the user U. Then, the ECTF characteristics acquisition unit 112 calculates the feature quantities hpL_U and hpR_U from the measurement data ECTFL and ECTFR, respectively (S12). The ECTF characteristics acquisition unit 112 performs Fourier transform of the measurement data of the ear canal transfer characteristics and thereby calculates the frequency-amplitude characteristics. The ECTF characteristics acquisition unit 112 extracts the frequency-amplitude characteristics in a specified frequency band and smoothes them. The feature quantities hpL_U and hpR_U, which serve as the user data, are thereby calculated. The transmitting unit 113 transmits the feature quantities hpL_U and hpR_U to the server device 300 (S13).

When the receiving unit 301 of the server device 300 receives the feature quantities hpL_U and hpR_U, the comparison unit 302 calculates similarity scores between the feature quantity hpL_U and all the feature quantities hpL_A to hpL_N and hpR_A to hpR_N in the data storage unit 303 (S14). Then, the comparison unit 302 selects the data set with the highest similarity score (S15). Note that a correlation between two feature quantities can be used as the similarity score. The similarity score is not limited to a correlation value, and it may be the length of a distance vector (Euclidean distance), cosine similarity (cosine distance), Mahalanobis' distance, Pearson correlation coefficient or the like. The comparison unit 302 selects the data set having the highest similarity score. The extraction unit 304 extracts the first preset data in the data set with the highest similarity score (S16). Specifically, the extraction unit 304 reads one first preset data from 2n number of first preset data.

The comparison unit 302 calculates similarity scores between the feature quantity hpR_U of the user U and all the feature quantities hpL_A to hpL_N and hpR_A to hpR_N stored in the data storage unit 303 (S17). Then, the comparison unit 302 selects the data set with the highest similarity score (S18). The extraction unit 304 extracts the first preset data in the data set with the highest similarity score (S19). Specifically, the extraction unit 304 reads one first preset data from 2n number of first preset data.

The transmitting unit 305 transmits the two first preset data extracted in S16 and S19 to the out-of-head localization device 100 (S20). The transmitting unit 305 thereby transmits four spatial acoustic transfer characteristics to the out-of-head localization device 100. Note that comparison and extraction of left and right feature quantities may be performed in a different order or performed in parallel.

In this manner, it is possible to determine an appropriate filter without performing the user measurement of the spatial acoustic transfer characteristics. This enhances the convenience.

A reason for extracting the spatial acoustic transfer characteristics from the similarity of the ear canal transfer characteristics is as follows. To obtain accurate out-of-head localization effect, it is necessary that the spatial acoustic transfer characteristics of other persons are similar to the spatial acoustic transfer characteristics or a user. In some cases, a method of using preset spatial acoustic transfer characteristics is not very effective at a high frequency where individuality affects. Further, a high frequency band is mainly affected by the external ear. The ear canal transfer characteristics are the transfer characteristics when headphones are worn, which are significantly affected by the external ear. Thus, it can be determined that external ear shape is similar in the ear canal transfer characteristics having a strong correlation in a high frequency band. Therefore, the frequency-amplitude characteristics in a high frequency band of 2 kHz or higher are used as the feature quantity. Then, the comparison unit 302 extracts the spatial acoustic transfer characteristics of a person being measured having the ear canal transfer characteristics with the similar frequency-amplitude characteristics in a high frequency band. Note that the feature quantity preferably contains the frequency-amplitude characteristics in a high frequency band of a specified frequency or higher. The specified frequency is preferably a frequency of 1 kHz to 3 kHz.

A result of studying the feature quantities of the ear canal transfer characteristics of 5 persons A to E being measured is described hereinafter. It is assumed that the feature quantity is data obtained by smoothing the frequency-amplitude characteristics at 2 kHz to 20 kHz of the ear canal transfer characteristics. Then, a correlation value between the feature quantities of two ears is calculated. Further, a correlation value between the spatial acoustic transfer characteristics Hls or spatial acoustic transfer characteristics Hrs of the left and right ears of the persons A to E being measured is calculated. In this example, a correlation value of the frequency-amplitude characteristics at 2 kHz to 20 kHz of the two spatial acoustic transfer characteristics is calculated. When a correlation value (similarity score) of the two feature quantities is high, a correlation value of the spatial acoustic transfer characteristics Hls or the spatial acoustic transfer characteristics Hrs is high. Several examples of measurement data are as follows.

Measurement Data 1 (left ear of person B being measured and right ear of person B being measured)
Correlation value: 0.940508
Correlation value of spatial acoustic transfer characteristics Hls_B and spatial acoustic transfer characteristics Hrs_B: 0.899687

Measurement Data 2 (right ear of person C being measured and left ear of person D being measured)
Correlation value: 0.962504
Correlation value of spatial acoustic transfer characteristics Hrs_C and spatial acoustic transfer characteristics Hls_D: 0.711014

Measurement Data 3 (right ear of person B being measured and right ear of person C being measured)
Correlation value: 0.898839
Correlation value of spatial acoustic transfer characteristics Hrs_B and spatial acoustic transfer characteristics Hrs_C: 0.859318

Measurement Data 4 (left ear of person A being measured and right ear of person B being measured)
Correlation value: 0.105869
Correlation value of spatial acoustic transfer characteristics Hls_A and spatial acoustic transfer characteristics Hrs_B: 0.328452

Measurement Data 5 (right ear of person A being measured and left ear of person D being measured)
Correlation value: 0.480002
Correlation value of spatial acoustic transfer characteristics Hrs_A and spatial acoustic transfer characteristics Hls_D: 0.388985

A correlation value between the feature quantities and a correlation value between the spatial acoustic transfer characteristics show a strong correlation. For example, as indicated by the measurement data 1 to 3, when a correlation value of the feature quantities is high, a correlation value of the spatial acoustic transfer characteristics is also high. Further, as indicated by the measurement data 4 to 5, when a correlation value of the feature quantities is low, a correlation value of the spatial acoustic transfer characteristics is also low.

Thus, in order to extract the spatial acoustic transfer characteristics of a person being measured with high similarity to the user U, the frequency-amplitude characteristics at 2 kHz or higher of the ear canal transfer characteristics are used as the feature quantity. The comparison unit 302 compares the feature quantity with the second preset data in the data storage unit 303. Based on a comparison result, the comparison unit 302 selects a person being measured with a high correlation value. It is preferred that the preset data in the data storage unit 303 is at least data measured in the same environment or conditions. For example, the microphone units 2 used in the first pre-measurement and the second pre-measurement are preferably the same. Further, the headphones 43 used in the second pre-measurement, the user measurement, and the out-of-head localization listening are preferably of the same type.

Figure 8:
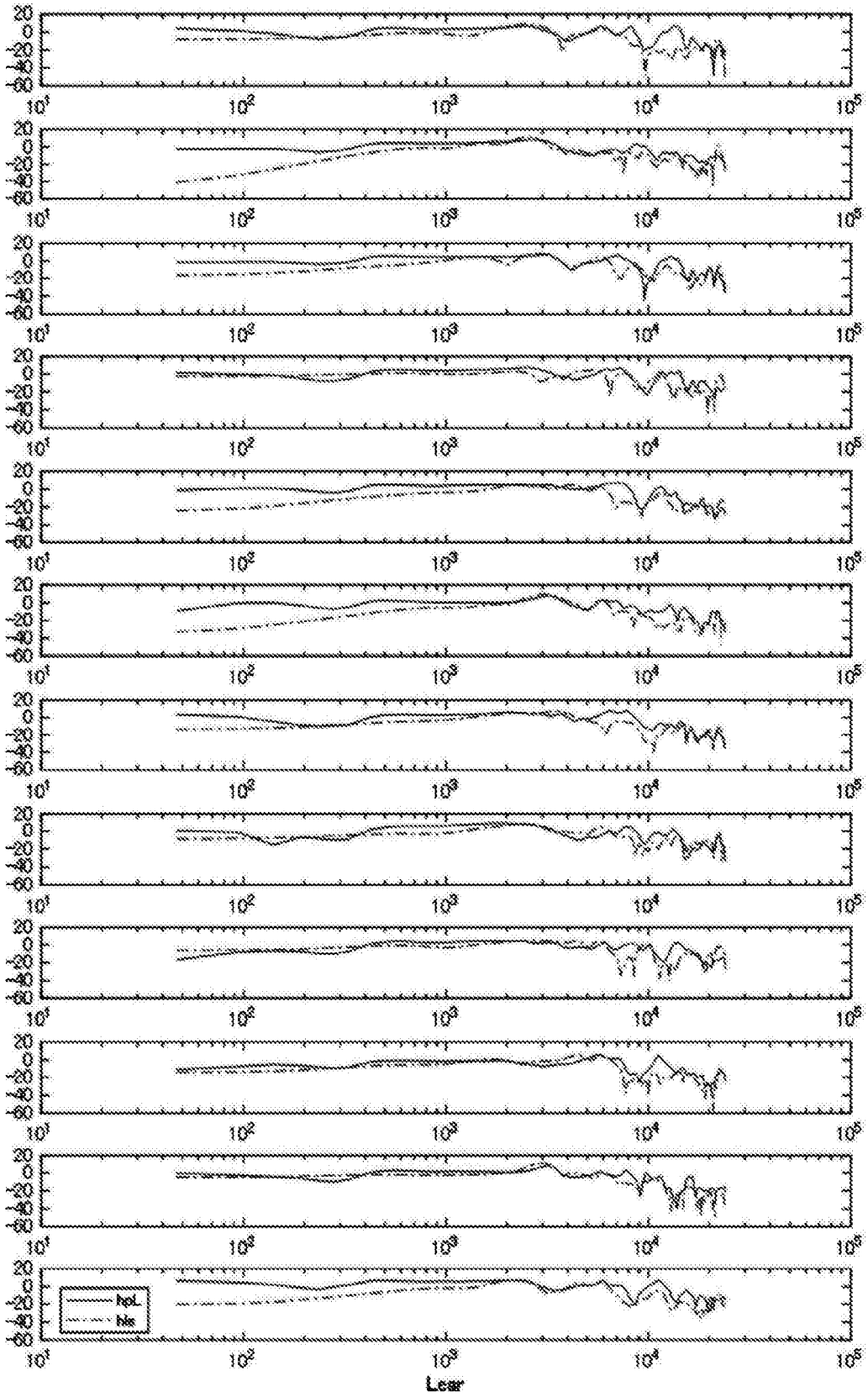
FIG. 8 is a view showing measurement data of spatial acoustic transfer characteristics and ear canal transfer characteristics.
Figure 9:
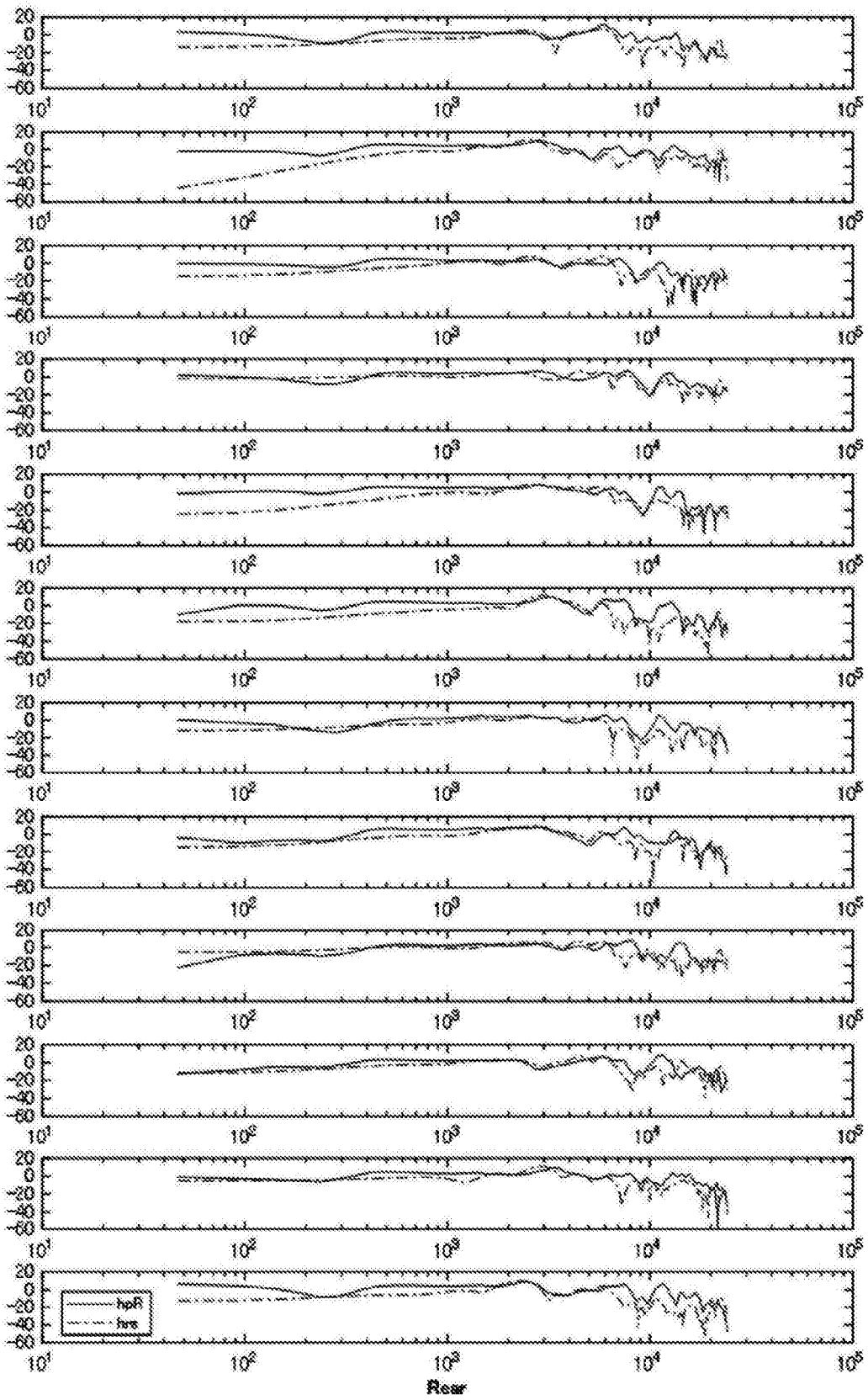
FIG. 9 is a view showing measurement data of spatial acoustic transfer characteristics and ear canal transfer characteristics.

FIGS. 8 and 9 show the measurement data of the ear canal transfer characteristics and the spatial acoustic transfer characteristics of a plurality of persons being measured. FIG. 8 is a view showing the ear canal transfer characteristics and the spatial acoustic transfer characteristics Hls of the left ear of 12 persons being measured. FIG. 9 is a view showing the ear canal transfer characteristics and the spatial acoustic transfer characteristics Hls of the right ear of 12 persons being measured. FIGS. 8 and 9 show the frequency-amplitude characteristics at 2 kHz to 20 kHz.

As shown in FIGS. 8 and 9, the waveforms of the ear canal transfer characteristics and the spatial acoustic transfer characteristics significantly vary by person being measured or by ear. It is thus difficult to directly calculate the spatial acoustic transfer characteristics from the ear canal transfer characteristics. It is thereby difficult to calculate the spatial acoustic transfer characteristics in the user terminal. Therefore, in this embodiment, the feature quantities of the ear canal transfer characteristics are compared, and the spatial acoustic transfer characteristics are extracted based on this comparison result.

Further, because the ear's shape, position and the like are different between left and right even in the same person being measured, the spatial acoustic transfer characteristics are different between the left and right ears. Thus, pairing of the spatial acoustic transfer characteristics preferably handles the left and right ears separately. Specifically, it is assumed that the feature quantity hpL, the spatial acoustic transfer characteristics Hls and the spatial acoustic transfer characteristics Hro form one data set related to the left ear, and the feature quantity hpR, the spatial acoustic transfer characteristics Hrs and the spatial acoustic transfer characteristics Hlo form one data set related to the right ear. It is thereby possible to appropriately determine the out-of-head localization filter.

MODIFIED EXAMPLE

The user data transmitted by the transmitting unit 113 is not limited to the feature quantity, and it may be the actual measurement data ECTF. The measurement data ECTF may be data in the time domain or data in the frequency domain. The frequency-amplitude characteristics in the entire frequency band may be transmitted as the user data from the transmitting unit 113 to the server device 300.

The second preset data is also not limited to the feature quantity of the ear canal transfer characteristics. The second preset data may be the ear canal transfer characteristics in the entire frequency band. Alternatively, the second preset data may be the ear canal transfer characteristics in the time domain. The second preset data may be any data related to the ear canal transfer characteristics of a person being measured. Then, the comparison unit 302 may perform processing on the second preset data and the user data to calculate the feature quantities in the same format.

The first preset data is also not limited to the spatial acoustic transfer characteristics in the time domain. For example, the first preset data may be the spatial acoustic transfer characteristics in the frequency domain. Note that the data storage unit 303 may store a data set for each person being measured, rather than storing a data set for each ear. Specifically, one data set may contain the four spatial acoustic transfer characteristics Hls, Hlo, Hro and Hrs and the feature quantities of measurement data of the ear canal transfer characteristics of the both ear.

Further, the frequency-amplitude characteristics, frequency-phase characteristics and the like of each data may be in Log scale or linear scale. The first and second preset data may contain other parameters or feature quantities. Specific examples of the data format of the preset data are described hereinafter with reference to FIGS. 10 to 12.

Modified Example 1

FIG. 10 is a table showing a data format of preset data in a modified example 1. In FIG. 10, the second parameter is the measurement data ECTFL and ECTFR of the ear canal transfer characteristics. Note that the measurement data ECTFL and ECTFR in the second pre-measurement may be data in the time domain or data in the frequency domain. In this case, the user data transmitted from the out-of-head localization device 100 may be the measurement data ECTFL and ECTFR. In this case, the comparison unit 302 calculates the feature quantity from the measurement data.

Because the data storage unit 303 stores the actual measurement data ECTF rather than the feature quantity, it is possible to change the feature quantity to be compared as appropriate. In other words, it is possible to modify the feature quantity so as to determine a more appropriate out-of-head localization filter. Further, the measurement data ECTFL and ECTFR may be used as the feature quantity without any change.

Further, in the modified example 1, paring of the spatial acoustic transfer characteristics in the first preset data is different from that in FIG. 6. A pair of the spatial acoustic transfer characteristics Hls and the spatial acoustic transfer characteristics Hlo is associated with the measurement data ECTFL of the ear canal transfer characteristics. For example, a data set for the left ear of the person A being measured contains measurement data ECTFL_A, spatial acoustic transfer characteristics Hls_A and spatial acoustic transfer characteristics Hlo_A. A pair of the spatial acoustic transfer characteristics Hrs and the spatial acoustic transfer characteristics Hro is associated with the measurement data of the ear canal transfer characteristics ECTFR. For example, a data set for the right ear of the person B being measured contains measurement data ECTFR_B, spatial acoustic transfer characteristics Hrs_B and spatial acoustic transfer characteristics Hro_B.

The spatial acoustic transfer characteristics Hls and Hrs have higher energy than the spatial acoustic transfer characteristics Hlo and Hro. Thus, a pair of the spatial acoustic transfer characteristics contained in a data set may be set as shown in FIG. 10. The spatial acoustic transfer functions Hls and Hrs of the ear closer to the speaker pass through a communication path outside the head. Thus, the spatial acoustic transfer functions Hls and Hrs are likely to be significantly affected by the external ear. In the modified example 1, the spatial acoustic transfer characteristics Hls and the spatial acoustic transfer characteristics Hlo are paired, and the spatial acoustic transfer characteristics Hrs and the spatial acoustic transfer characteristics Hro are paired.

Note that, due to the symmetric property of the ear and the speaker layout, the ear canal transfer characteristics that are most similar to the ear canal transfer characteristics of the left ear of the user U can be data of the right ear of the person 1 being measured. Likewise, the ear canal transfer characteristics that are most similar to the ear canal transfer characteristics of the right ear of the user U can be data of the left ear of the person 1 being measured.

Modified Example 2

FIG. 11 is a table showing a data format of preset data in a modified example 2. In the modified example 2, the first preset data contains delay and level in addition to the spatial acoustic transfer characteristics 1 and the spatial acoustic transfer characteristics 2. The delay indicates a difference in arrival time between the spatial acoustic transfer characteristics 1 and the spatial acoustic transfer characteristics 2. For example, the delay ITDL_A is a difference between the arrival time of an impulse sound in the spatial acoustic transfer characteristics Hls_A and the arrival time of an impulse sound in the spatial acoustic transfer characteristics Hlo_A. The delay is a value dependent on the size of the head of a person being measured.

The level is a difference between the amplitude level of the spatial acoustic transfer characteristics 1 and the amplitude level of the spatial acoustic transfer characteristics 2. For example, the level ILDL_A is a difference between an average value of the frequency-amplitude characteristics of the spatial acoustic transfer characteristics Hls_A in the entire frequency band and an average value of the frequency-amplitude characteristics of the spatial acoustic transfer characteristics Hlo_A in the entire frequency band. In this manner, the feature quantity of a pair of the spatial acoustic transfer characteristics is contained in the first preset data.

Then, the transmitting unit 305 transmits this feature quantity to the out-of-head localization device 100. The out-of-head localization device 100 adjusts the feature quantity by auditory test on the user U or the like. The spatial acoustic filter can be optimized by using the adjusted feature quantity.

For example, when the out-of-head localization unit 10 convolves the spatial acoustic filter of the spatial acoustic transfer characteristics Hls and Hrs, the delay may be set to 0, and the delay of the spatial acoustic transfer characteristics Hlo and Hro may be changed as appropriate.

Further, in order to further enhance the localization effect in a low frequency band also, the delay may be adjusted by the user U. The user adjusts the delay between the spatial acoustic transfer characteristics Hls and the spatial acoustic transfer characteristics Hlo and the delay between the spatial acoustic transfer characteristics Hrs and the spatial acoustic transfer characteristics Hro independently of one another.

Alternatively, the spatial acoustic transfer characteristics may be delayed with the amount of delay depending on head circumference. For example, the user U may input a measured value of head circumference or a hat size. This allows the spatial acoustic transfer characteristics Hlo and Hro to be delayed from the spatial acoustic transfer characteristics Hls and Hrs with the amount of delay depending on head circumference.

A phase difference (delay) in middle and low frequencies may be calculated by inputting a numerical value of the left and right ear width or head circumference of the user U. Then, delay and level differences may be reflected on the spatial acoustic transfer characteristics Hls and Hrs on the measured person side and the spatial acoustic transfer characteristics Hlo and Hro on the crosstalk side. In this manner, it is possible to calculate the spatial acoustic filter in consideration of the delay, level and the like.

The second preset data contains the feature quantities hpL and hpR and the measurement data ECTFL and ECTFR of the ear canal transfer characteristics. Because the second preset data contains the feature quantities, there is no need to calculate the feature quantities from the ear canal transfer characteristics at the time of comparison. This simplifies the process. Further, because the second preset data contains the measurement data of the ear canal transfer characteristics, it is possible to modify the feature quantity. For example, it is possible to change the frequency band of the frequency-amplitude characteristics, which serve as the feature quantity.

Modified Example 3

FIG. 12 is a table showing a data format of preset data in a modified example 3. In the modified example 3, the first preset data contains frequency-phase characteristics 1, frequency-phase characteristics 2, frequency-amplitude characteristics 1 and frequency-amplitude characteristics 2 of the spatial acoustic transfer characteristics. Further, the second preset data has feature quantity 1 and feature quantity 2.

The feature quantity 1 is the frequency-amplitude characteristics at 2 kHz to 20 kHz of the ear canal transfer characteristics. The feature quantity 2 is the frequency-amplitude characteristics in a low frequency band of less than 2 kHz of the ear canal transfer characteristics. For example, a similarity score may be calculated by assigning weights to the two types of feature quantities.

In the modified example 3, the data storage unit 303 stores the spatial acoustic transfer characteristics in the frequency domain as the first preset data. For example, by performing Fourier transform of the spatial acoustic transfer characteristics Hls_A in the time domain, the frequency-amplitude characteristics Hls_am_A and the frequency-phase characteristics Hls_p_A are calculated. Then, the data storage unit 303 stores the frequency-amplitude characteristics and the frequency-phase characteristics as the first preset data.

The transmitting unit 305 then transmits the frequency-amplitude characteristics and the frequency-phase characteristics in the extracted data set to the out-of-head localization device 100. Then, the out-of-head localization device 100 generates the spatial acoustic filter of the spatial acoustic transfer characteristics based on the frequency-amplitude characteristics and the frequency-phase characteristics. Alternatively, the server device 300 may generate the spatial acoustic filter of the spatial acoustic transfer characteristics based on the frequency-amplitude characteristics and the frequency-phase characteristics. Then, the server device 300 may transmit the generated spatial acoustic filter to the out-of-head localization device 100. Further, the server device 300 may perform a part of the filter generation process, and the out-of-head localization device 100 may perform the rest of the process.

Other Embodiments

A user terminal that serves as the out-of-head localization device 100 is a personal computer, a smartphone, a portable music player, an mp3 player, or a tablet terminal. Note that the user terminal is not limited to a physically single device. For example, the user terminal may have a structure that combines a portable music player and a personal computer.

In this case, the portable music player, to which headphones are connected, has a function of generating a measurement signal, and the personal computer, to which a microphone unit is connected, has a function of storing measurement data and a communication function of transmitting user data.

Further, a user terminal that performs user measurement and a user terminal that performs out-of-head localization may be different terminals. This allows a user to listen to a reproduced signal on which out-of-head localization has been performed by using an arbitrary user terminal. Further, a user can share the same out-of-head localization filter among a plurality of terminals (reproduction devices). In this case, the same out-of-head localization filter is set for the same headphones 43, and different out-of-head localization filters are set for different headphones 43.

The user data may be measurement data actually obtained by measurement, or a part of measurement data extracted from the measurement data. Further, the user data may be data obtained by performing processing such as smoothing on the measurement data.

A plurality of first preset data with high similarity may be presented to allow the user U to select one. For example, the comparison unit 302 selects three data sets with a high similarity score. The transmitting unit 305 transmits three first preset data for each ear. The user U may select the most appropriate first preset data based on auditory feeling upon out-of-head localization listening using the three first preset data. Further, the spatial acoustic filter may be corrected according to the auditory feeling.

When the data storage unit 303 calculates the similarity, it may assign weights depending on frequency. Alternatively, the frequency band to be used as the feature quantity may be changed. Because the external ear affects the auditory effect at about 2 kHz to 16 kHz, the feature quantity preferably contains an amplitude value in this band. Further, the frequency-amplitude characteristics may be in Log scale or linear scale.

The data storage unit 303 may store the measurement data ECTF of the ear canal transfer characteristics, and the comparison unit 302 may calculate the feature quantity. Thus, the second preset data stored in the data storage unit 303 may be any data related to the ear canal transfer characteristics of the ear of a person being measured. For example, the second preset data may be the ear canal transfer characteristics in the time domain or the ear canal transfer characteristics in the frequency domain. Further, the second preset data may be data obtained by extracting a part of the ear canal transfer characteristics. The second preset data may be data obtained by performing processing such as smoothing on measurement data of the ear canal transfer function.

The first preset data may be any data related to the spatial acoustic transfer characteristics of the left and right ears of the person 1 being measured. The first preset data may be the spatial acoustic transfer characteristics in the time domain or the spatial acoustic transfer characteristics in the frequency domain. Further, the first preset data may be data obtained by extracting a part of the spatial acoustic transfer characteristics.

The preset data may be gradually accumulated. Specifically, when a new user (person being measured) measures the spatial acoustic transfer characteristics in addition to measuring the ear canal transfer characteristics, a new data set is added based on this measurement data. This allows a gradual increase in the number of data sets of candidate preset data, and it is thereby possible to determine the spatial acoustic filter suitable for the user U.

Note that the server device 300 may collect the preset data form a plurality of measurement devices 200. For example, the server device 300 acquires the preset data from a plurality of measurement devices 200 through a network such as the Internet. This allows an increase in the number of data sets of candidate preset data. It is thus possible to determine the filter more suitable for the user U.

The headphones 43 and the microphone unit 2 may wirelessly input and output signals. Further, earphones may be used instead of the headphones 43 as an output unit that outputs sounds to a user's ear.

Data in the data storage unit 303 may be previously sorted (or linked by tag etc.) based on measurement environment (listening room, studio, etc.). The user terminal then displays a plurality of listening rooms for the user U. The user U selects a desired listening room. After the user data is transmitted from the user terminal, the server device 300 calculates the similarity with the feature quantity linked to the designated listening room, and transmits the first preset data set of the person being measured with high correlation to the user terminal. The user U can do trial listening with out-of-head localization using the first preset data and, if the user likes it, purchase and pay for it. A price (for example, several %) based on this payment may be paid to a person being measured who has provided data.

A part or the whole of the above-described processing may be executed by a computer program. The above-described program can be stored and provided to the computer using any type of non-transitory computer readable medium. The non-transitory computer readable medium includes any type of tangible storage medium. Examples of the non-transitory computer readable medium include magnetic storage media (such as floppy disks, magnetic tapes, hard disk drives, etc.), optical magnetic storage media (e.g. magneto-optical disks), CD-ROM (Read Only Memory), CD-R, CD-R/W, and semiconductor memories (such as mask ROM, PROM (Programmable ROM), EPROM (Erasable PROM), flash ROM, RAM (Random Access Memory), etc.). The program may be provided to a computer using any type of transitory computer readable medium. Examples of the transitory computer readable medium include electric signals, optical signals, and electromagnetic waves. The transitory computer readable medium can provide the program to a computer via a wired communication line such as an electric wire or optical fiber or a wireless communication line.

Although embodiments of the invention made by the present invention are described in the foregoing, the present invention is not restricted to the above-described embodiments, and various changes and modifications may be made without departing from the scope of the invention.

The present disclosure is applicable to out-of-head localization technology.

What is claimed is:

1. An out-of-head localization filter determination system comprising:

an output unit configured to be worn on a user and output sounds to an ear of the user;

a microphone unit configured to be worn on the ear of the user and pick up sounds output from the output unit;

a user terminal configured to output a measurement signal to the output unit and acquire a sound pickup signal output from the microphone unit; and a server device configured to be able to communicate with the user terminal, wherein the user terminal includes:

a measurement unit configured to measure measurement data related to ear canal transfer characteristics of the ear of the user by using the output unit and the microphone unit, and a transmitting unit configured to transmit user data based on the measurement data to the server device, and the server device includes:

a data storage unit configured to store first preset data related to spatial acoustic transfer characteristics from a sound source to an ear of a person being measured and second preset data related to ear canal transfer characteristics of the ear of the person being measured in association with each other, and store a plurality of first and second preset data acquired for a plurality of persons being measured, a comparison unit configured to compare the user data with the plurality of second preset data, and an extraction unit configured to extract first preset data of a person being measured corresponding to second preset data extracted based on a comparison result in the comparison unit, and the comparison unit acquires, for each of the user data and the second preset data, a first feature quantity based on frequency-amplitude characteristics at a specified frequency or higher and a second feature quantity based on frequency-amplitude characteristics at less than the specified frequency, of ear canal transfer characteristics of the user and the person being measured, the comparison unit compares the first and second feature quantities of the user data with the first and second feature quantities of the second preset data, respectively, and calculates a similarity score, the comparison unit extracts the second preset data based on the similarity score, and the specified frequency is a frequency of 1 kHz to 3 kHz.

2. The out-of-head localization filter determination system according to claim 1, wherein the server device transmits the first preset data extracted by the extraction unit to the user terminal, and the user terminal performs out-of-head localization based on a spatial acoustic filter corresponding to the first preset data and an inverse filter based on the measurement data.

3. The out-of-head localization filter determination system according to claim 1, wherein the data storage unit stores first preset data related to spatial acoustic transfer characteristics from a sound source to a left ear of the person being measured and second preset data related to ear canal transfer characteristics from a sound source to the left ear of the person being measured in association with each other as a data set of a left ear, the data storage unit stores first preset data related to spatial acoustic transfer characteristics from a sound source to a right ear of the person being measured and second preset data related to ear canal transfer characteristics from a sound source to the right ear of the person being measured in association with each other as a data set of a right ear, the comparison unit compares user data based on measurement data related to ear canal transfer characteristics of a left ear of the user with each of the second preset data in the data set of the left ear and the second preset data in the data set of the right ear, the comparison unit compares user data based on measurement data related to ear canal transfer characteristics of a right ear of the user with each of the second preset data in the data set of the left ear and the second preset data in the data set of the right ear, and the first preset data contains a delay being a time difference of the spatial acoustic transfer characteristics between the left ear and the right ear of the person being measured.

4. The out-of-head localization filter determination system according to claim 1, wherein the comparison unit compares the first and second feature quantities of the user data with the first and second feature quantities of the second preset data, respectively, assigns specified weights and calculates the similarity score.

5. An out-of-head localization filter determination device comprising:

an acquisition unit configured to acquire user data based on measurement data related to ear canal transfer characteristics of an ear of a user;

a data storage unit configured to store first preset data related to spatial acoustic transfer characteristics from a sound source to an ear of a person being measured and second preset data related to ear canal transfer characteristics of the ear of the person being measured in association with each other, and store a plurality of first and second preset data acquired for a plurality of persons being measured;

a comparison unit configured to compare the user data with the plurality of second preset data; and an extraction unit configured to extract first preset data of a person being measured corresponding to second preset data extracted based on a comparison result in the comparison unit, wherein the comparison unit acquires, for each of the user data and the second preset data, a first feature quantity based on frequency-amplitude characteristics at a specified frequency or higher and a second feature quantity based on frequency-amplitude characteristics at less than the specified frequency, of ear canal transfer characteristics of the user and the person being measured, the comparison unit compares the first and second feature quantities of the user data with the first and second feature quantities of the second preset data, respectively, and calculates a similarity score, the comparison unit extracts the second preset data based on the similarity score, and the specified frequency is a frequency of 1 kHz to 3 kHz.

6. An out-of-head localization filter determination method comprising:

a step of acquiring user data based on measurement data related to ear canal transfer characteristics of an ear of a user;

a step of storing a plurality of first and second preset data acquired for a plurality of persons being measured, in such a way that associates first preset data related to spatial acoustic transfer characteristics from a sound source to an ear of a person being measured and second preset data related to ear canal transfer characteristics of the ear of the person being measured;

a step of acquiring, for each of the user data and the second preset data, a first feature quantity based on frequency-amplitude characteristics at a specified frequency or higher and a second feature quantity based on frequency-amplitude characteristics at less than the specified frequency, of ear canal transfer characteristics of the user and the person being measured, where the specified frequency is a frequency of 1 kHz to 3 kHz;

a step of comparing the first and second feature quantities of the user data with the first and second feature quantities of the second preset data, respectively;

a step of calculating a similarity score based on a result of the comparison;

a step of extracting the second preset data based on the similarity score; and a step of extracting first preset data of a person being measured corresponding to the extracted second preset data.

* * * * *